US005213519A

United States Patent [19]

Dorfman

[11] Patent Number: 5,213,519

[45] Date of Patent: May 25, 1993

[54] ELECTRICAL RECEPTACLE ARRANGEMENT

[76] Inventor: David J. Dorfman, 108-48 70th Rd., Forest Hills, N.Y. 11375

[21] Appl. No.: 859,807

[22] Filed: Mar. 30, 1992

[51] Int. Cl.[5] ..... H01R 11/00

[52] U.S. Cl. ..... 439/505; 439/648; 362/123

[58] Field of Search ..... 439/505, 640, 648; 362/123, 238

[56] References Cited

U.S. PATENT DOCUMENTS

| | | | |
|---|---|---|---|
| 2,414,866 | 1/1947 | Glaser | 439/639 |
| 3,096,943 | 7/1963 | Forrer | 439/505 |
| 3,277,291 | 10/1966 | Holbrook | 439/505 |
| 4,099,824 | 7/1978 | Schoppelrey | 439/505 |
| 4,620,270 | 10/1986 | Laakso | 362/419 |
| 4,870,547 | 9/1989 | Crucefix | 362/227 |
| 5,057,976 | 10/1991 | DuMong | 362/123 |

*Primary Examiner*—Gary F. Paumen
*Attorney, Agent, or Firm*—Goodman & Teitelbaum

[57] ABSTRACT

An electrical receptacle arrangement to receive light bulbs, power cord plugs and the like including two electrically conductive wires, each wire having a serpentine configuration, the wires being disposed adjacent to each other and being oriented at an angle to each other so that the wires cross each other at aligned points forming a net-like construction, with receptacles being connected at selected ones of the aligned points to provide a parallel circuit, and the wires being separately connected to an electrical power source. In one embodiment, the electrical receptacle arrangement forms a flexible net, where when the receptacles receive light bulbs therein, a blanket of light is provided which can be drapped over and around a Christmas tree for decorative purposes. In another embodiment, the electrical receptacle arrangement is fixedly installed in a ceiling to receive light bulbs in the receptacles for illumination purposes. In a further embodiment, the electrical receptacle arrangement is provided in a panel, wall or board disposed vertically or horizontally so that the receptacles can receive power cord plugs therein to energize electrical devices.

20 Claims, 2 Drawing Sheets

ELECTRICAL RECEPTACLE ARRANGEMENT

BACKGROUND OF THE INVENTION

The invention relates to an electrical receptacle arrangement and, more particularly, to an electrical receptacle arrangement to provide numerous electrical receptacles disposed in a parallel circuit to receive light bulbs, power cord plugs and the like therein, where the arrangement can be constructed as a flexible net to provide a blanket of light when the light bulbs are positioned therein, or the arrangement can be constructed to provide stationery receptacles in ceilings, panels and the like to receive light bulbs or power cord plugs.

Electrical receptacle arrangements provided with a parallel circuit are well known in the art, where the parallel circuit includes two line wires for connectfion to an electric outlet and two branch wires for each receptacle with each branch wire being connected between the associated reeptacle and one of the line wires, such as disclosed in U.S. Pat. No. 4,099,824. This patent discloses a mechanically adjustable electric outlet device including a plurality of female receptacle plugs connected in parallel circuit and a semi-stiff, spring-metal wire which is resistantly formed into a circle of variable diameter so as to mount at the top of Christmas trees of various diameter trunks.

Other prior art electrical receptacle arrangements which are used to decorate Christmas trees are disclosed in U.S. Pat. No. 2,414,866, U.S. Pat. No. 3,096,943, U.S. Pat. No. 4,620,270 and U.S. Pat. No. 4,870,547. Of these patents, U.S. Pat. No. 3,096,943 is of most interest, in that this patent discloses a net forming a blanket of lights, the net including rises and connectors of nonconductive material so that pairs of electrically conductive insulated wires (not shown) can be entwined around the rises and connectors to provide the blanket of light, where it is not disclosed whether the electrical wires are in a series or parallel circuit.

Therefore, there is presently a need for an electrical receptacle arrangement which has a simple parallel circuit that can be easily constructed, whether the parallel circuit is flexible or stationrily fixed.

SUMMARY OF THE INVENTION

It is accordingly an object of the present invention to provide an electrical receptacle arrangement which avoids the problems and disadvantages of the prior art arrangements.

Another object of the present invention is to provide an electrical receptacle arrangement having receptacles connected together in a parallel circuit.

A further object of the present invention is to provide an elecrtrical receptacle arrangement as described above which includes electrically conductive wires having serpentine configurations disposed adjacent to each other at a predetermined angle with respect to each other so that one wire crosses the other wire at aligned points to which the receptacles are electrically connected to provide the parallel circuit.

Still another object of the present invention is to provide an electrical receptacle arrangement as described above which forms a flexible net to provide a blanket of light when light bulbs are received in the receptacles.

Another object of the present invention is to provide an electrical receptacle arrangement as described above wherein the blanket of light is drapped over and around a Christmas tree for decoration thereof.

Yet another object of the present invention is to provide an electrical receptacle arrangement as described above which is installed within a ceiling to receive light bulbs in the receptacles for illumination purposes.

Yet another object of the present invention is to provide an electrical receptacle arrangement as described above which is mounted in a panel, wall or board, disposed vertically or horizontally, to receive power cord plugs in the receptacles to energize electrical devices.

A further object of the present invention is to provide an electrical receptacle arrangement as described above that is relatively inexpensive and simple in construction, one that is capable of being applied as a unit.

Briefly, in accordance with the present invention, there is provided an electrical receptacle arrangement including two electrically conductive wires, each having a serpentine configuration, the wires being disposed adjacent to each other and oriented at an angle to each other so that the wires cross each other at aligned points, to form a net-like construction, with receptacles being connected at selected ones of the aligned points to provide a parallel circuit, the wires being separately connected to an electrical power source. In one embodiment, the electrical receptacle arrangement forms a flexible net, where when the receptacles receive light bulbs therein, a blanket of light is provided which can be drapped over and around a Christmas tree for decorative purposes. In another embodiment, the electrical receptacle arrangement is installed in a ceiling to receive light bulbs in the receptacles for illumination purposes. In a further embodiment, the electrical receptacle arrangement is provided in a panel, wall or board disposed vertically or horizontally so that the receptacles can receive power cord plugs therein to energize electrical devices.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

In various figures of the drawings, like reference characters designate like parts.

DESCRIPTION OF THE PREFERRED EMBODIMENTS

Figure 1:
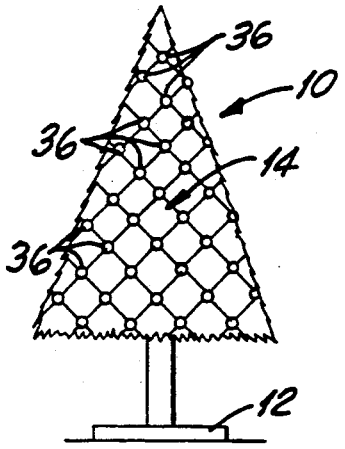
FIG. 1 is a front elevational view of a Christmas tree decorated with the electrical receptacle arrangement according to the present invention.
Figure 2:
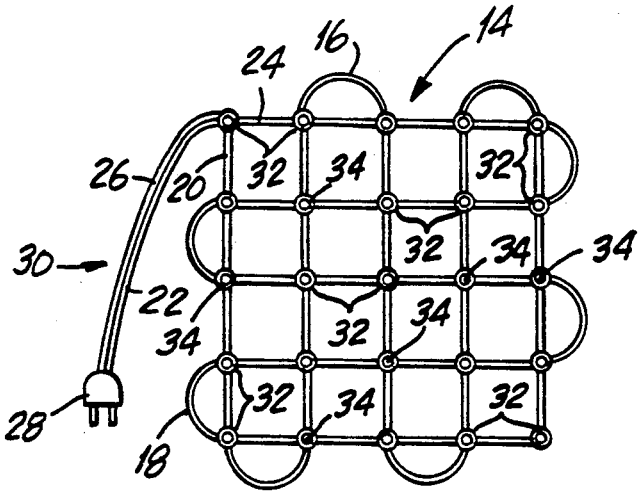
FIG. 2 is a top plan view of the electrical receptacle arrangement shown in FIG. 1.

Referring no w to the drawings, FIG. 1 show s a conventional Christmas tree 10 mounted on a stand 12, where the Christmas tree 10 is decorated with an electrical receptacle arrangement 14 according to the present invention. As best shown in FIG. 2, the electrical receptacle arrangement 14 includes a first electrically conductive insulated continuous wire 16 imposed over an adjacent second electrically conductive insulated continuous wire 18. Each of the wires have a serpentine configuration and are disposed at any desired predetermined angle to each other when viewed in a plan view. Preferably, the wire 16 is turned 90 degrees to be oriented at a right angle to the wire 18, as shown in FIG. 2, to provide a net-like construction. The corner end 20 of the wire 16 is connected to a line wire 22, and the corner end 24 of the wire 18 is connected to a line wire 26. The ends of the line wires 22, 26 are separately connected to a conventional electrical male plug 28 to provide an electrical power cord 30 for the electrical receptacle arrangement 14 which can be plugged into a conventional electrical power source (not shown).

Figure 3:
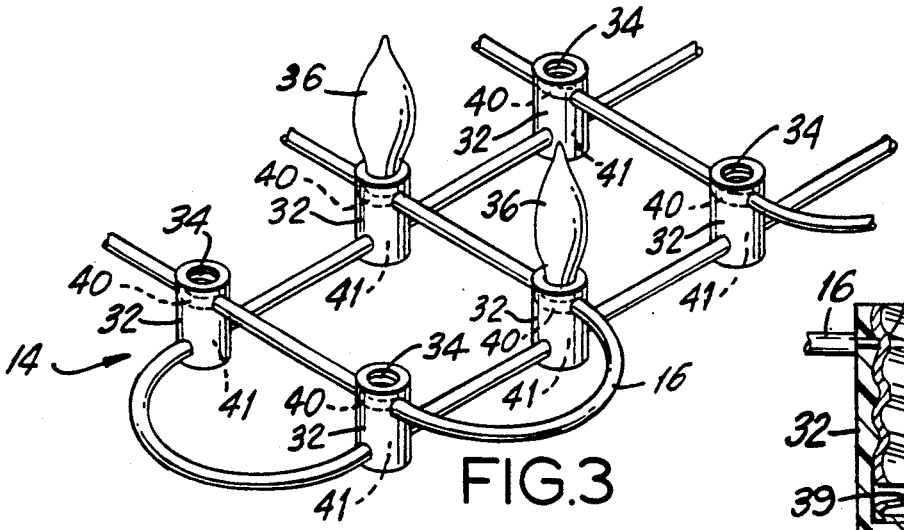
FIG. 3 is a fragmented enlarged perspective view of the electrical receptacle arrangement of FIG. 2.
Figure 4:
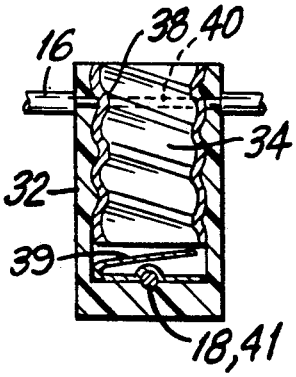
FIG. 4 is a cross sectional view of the receptacle of FIG. 3.

As best shown in FIG. 3, each of the wires 16, 18 is connected to a conventional electrical receptacle, particularly a light bulb receptacle 32, at each of the selected aligned points where the wires 16, 18 cross each other. Each of the receptacles 32 is fabricated from a non-electrically conductive material, such as plastic, and has a threaded opening 34 therein to threadedly receive illuminating means therein, such as a light bulb 36. With structure well known in the art, each receptacle 32 is provided with two spaced apart electrical terminals 38, 39 therein. A non-insulated portion 40 of the wire 16 is electrically connected to one electrical terminal 38 such as a threaded metal insert, with a non-insulated portion 41 of the wire 18 being electrically connected to the other electrical terminal 39 such as a bent metal leaf spring, as shown in FIG. 4 so that the light bulb 36, when screwed into the opening 34 of the receptacle 32, completes the circuit between the two electrical terminals 38, 39 of the receptacle 32 in order for the light bulb 36 to light when the plug 28 of the power cord 30 is plugged into an electrical power source. Thus, with the above-mentioned arrangement, each of the receptacles 32 are electrically arranged parallel to each other so that the light bulbs 36 when disposed in the parallel circuit will light independently with respect to each other.

The electrically conductive insulated wires 16, 18 are flexible so that the net-like configuration of the electrical receptacle arrangement 14 is also flexible. Accordingly, the light bulbs 36 are inserted into the receptacles 32, and then the flexible net-like construction is drapped over and around the Christmas tree 10, as shown in FIG. 1. Then, the plug 28 is plugged into the conventional power source to provide a decorative blanket of light on the Christmas tree 10.

Figure 5:
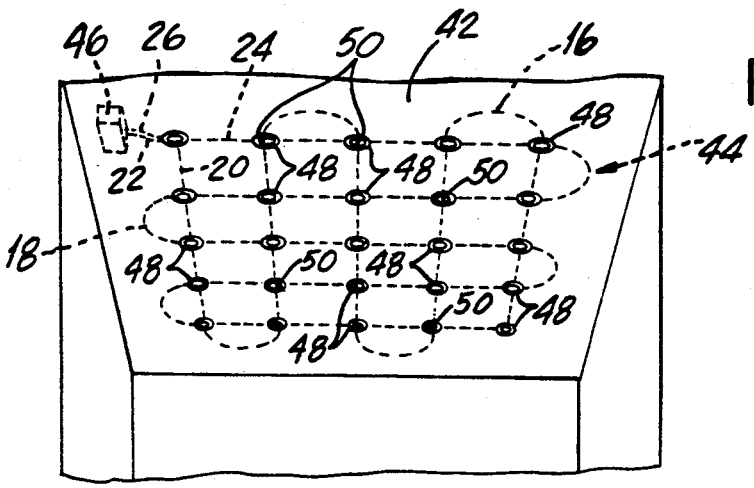
FIG. 5 is a fragmented perspective view of a ceiling provided with a modified electrical receptacle arrangement according to the present invention.
Figure 6:
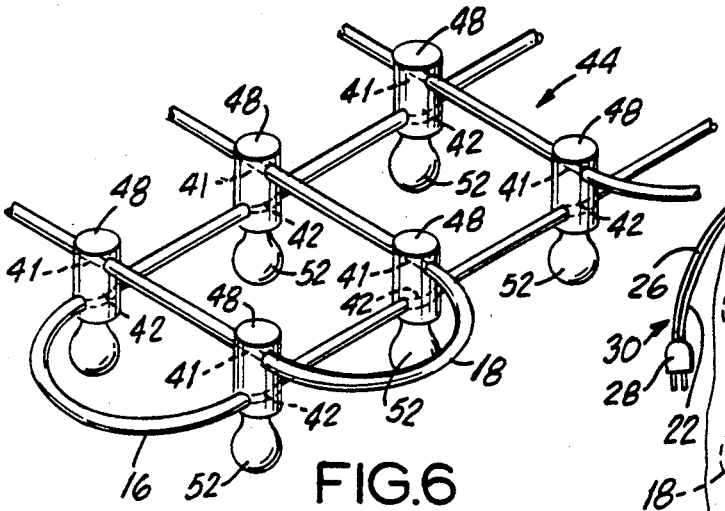
FIG. 6 is a fragmented perspective view of the modified electrical receptacle arrangement of FIG. 5.

FIG. 5 is directed to a modified embodiment of the invention, showing a conventional ceiling 42 having the modified electrical receptacle arrangement 44 installed therein. In this embodiment, the electrically conductive insulated continuous wire 18 of the electrical receptacle arrangement 44 is imposed over the other electrically conductive insulated continuous wire 16, as best shown in FIG. 6. Here again, each of the wires 16, 18 have a serpentine configuration disposed at 90 degrees to each other to provide a right angle relationship providing the net-like construction, where obviously as mentioned above the wires 16, 18 can be disposed at any desired predetermined angle to each other when viewed in a plan view. In this case, the line wires 22, 26 connected to the corner ends 20, 24, respectively, are separately connected to a conventional electrical power source 46 well known in the art.

Each of the wires 16, 18 is likewise connected to a conventional electrical receptacle 48 at each of the selected aligned points where the wires 16, 18 cross each other. Each of the receptacles 48 is similar to the above-mentioned receptacle 32, being fabricated from a non-electrically conductive material, such as plastic, however the receptacle 48 is dimensioned larger than the receptacle 32. Each receptacle 48 has a threaded opening 50 therein to threadedly receive illuminating means therein, such as a conventional light bulb 52.

The internal structure of the receptacle 48 is similar to the internal structure of the receptacle 32, being provided with two spaced apart electrical terminals therein, with a noninsulated portion 40 of the wire 16 being electrically connected to one electrical terminal such as the threaded metal insert, and a non-insulated portion 41 of the wire 18 being electrically connected to the other terminal such as the bent metal leaf spring, so that the light bulb 52, when screwed into the opening 50 of the receptacle 48, completes the circuit between the two electrical terminals of the receptacle 48 in order for the light bulbs 52 to light when the power source 46 is switched on, such as by a conventional wall light switch (not shown). Here again, with the above-mentioned arrangement, each of the receptacles 48 are electrically arranged parallel to each other so that the light bulbs 52 when disposed in the parallel circuit will light independently with respect to each other.

It is noted, that instead of having the receptacles 48 mounted directly on the surface of the ceiling 42, the receptacles 48 can be recessed from the ceiling 42 and used with conventional high hats well known in the art, where flood lights would be positioned in the high hats and threaded into the recessed receptacles 48.

Figure 7:
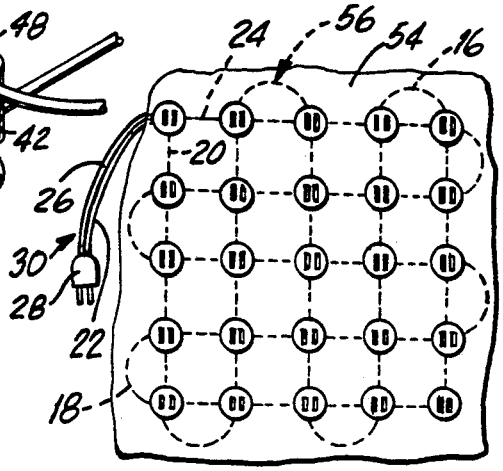
FIG. 7 is a fragmented front elevational view of a panel provided with a further modified electrical receptacle arrangement according to the present invention.
Figure 8:
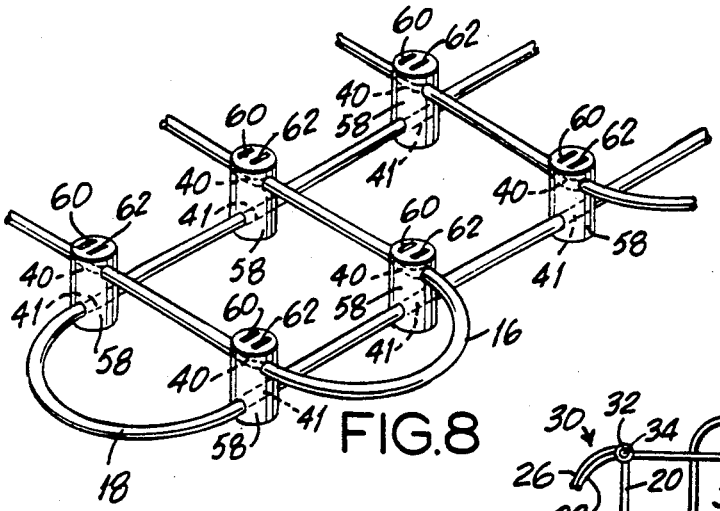
FIG. 8 is a fragmented perspective view of the further modified electrical receptacle arrangement shown in FIG. 7.

FIG. 7 shows a conventional panel, wall or board 54 provided with a further modified electrical receptacle arrangement 56 according to the present arrangement. In this embodiment, the electrically conductive insulated continuous wire 16 of the electrical receptacle arrangement 56 is imposed over or in front of the other adjacent electrically conductive insulated continuous wire 18, as best shown in FIG. 8. Here again, each of the wires 16, 18 have a serpentine configuration disposed at 90 degrees to each other to provide a right angle relationship providing the net-like construction, where obviously as mentioned above the wires 16, 18 can be disposed at any desired predetermined angle to each other when viewed in either a plan view or an elevational view. Preferably, the line wires 22, 26 are connected to the corner ends 20, 24, respectively to provide the electrical power cord 30 having the conventional electrical male plug 28 at the free end thereof, as mentioned above.

Each of the wires 16, 18 is likewise connected to a conventional electrical receptacle 58 at each of the selected aligned points where the wires 16, 18 cross each other. In this case, the receptacle 58 is a conventional power cord plug receiving receptacle being fabricated from a non-electrically conductive material, such as plastic. Each receptacle 58 has a pair of slots 60, 62 extending inwardly from a front end thereof to receive the prongs of a power cord plug.

Figure 9:
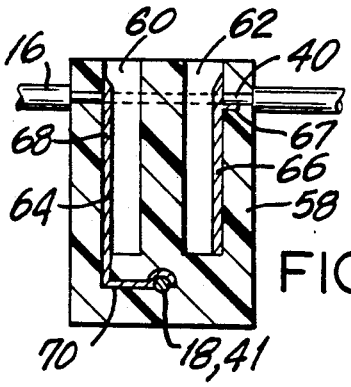
FIG. 9 is a cross sectional view of the receptacle of FIG. 8.

As shown in FIG. 9, each receptacle 58 is provided internally with two spaced apart electrical terminals 64, 66. The non-insulated portion 40 of the wire 16 being electrically connected to the electric terminal 66 such as an elongated metal strip secured by a tab 67 in the slot 62, where the portion 40 can be secured to the tab 67. The non-insulated portion 41 of the wire 18 is electrically connected to the other electrical terminal 64 such as an L-shaped wire strip having the long leg 68 thereof longitudinally extending within the slot 60 and the short leg 70 thereof secured in the body of the receptacle 58, where the non-insulated portion 41 is connected at the end of the short leg 70.

Accordingly, when the prongs of a power cord plug of an electrical device are inserted into the slots 60, 62, the circuit between the two electrical terminals 64, 66 is completed to energize the electrical device when the device is turned on and when the plug 28 is plugged into the conventional power source. Here again, with the above-mentioned arrangement, each of the receptacles 58 are electrically arranged parallel to each other so that the electrical devices when disposed in the parallel circuit will be energized independently with respect to each other.

It is noted, that the panel, wall or board 54 can be disposed vertically or horizontally with the front end of the receptacles 58 having the slots 60, 62 therein being exposed to receive the power cord plugs of the electrical devices therein.

Figure 10:
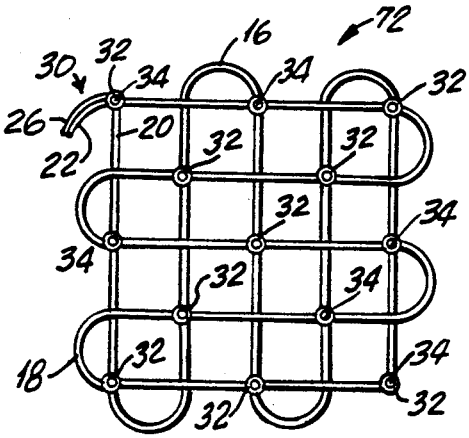
FIG. 10 is a top plan view of a still further modified electrical receptacle arrangement similar to the electrical receptacle arrangement shown in FIG. 2, according to the present invention.

FIG. 10 shows a still further modified electrical receptacle arrangement 72 similar to the electrical receptacle arrangement 14 shown in FIG. 2, where the parts are similar except for the wire 18 being disposed over the wire 16. Furthermore, the receptacles 32 are not connected at all of the aligned points formed by the wires 16, 18 crossing each other, but rather the receptacles 32 are only connected at selected ones of these aligned points, such as being connected at alternate aligned points as shown. Thus, the receptacles 32 can be positioned to provide any desired configuration thereon depending upon the needs of the user.

Numerous alterations of the structures herein disclosed will suggest themselves to those skilled in the art. However, it is to be understood that the present disclosure relates to preferred embodiments of the invention which are for the purposes of illustration only.

What is claimed is:

1. An electrical receptacle arrangement to receive one of light bulbs, power cord plugs and the like, comprising:

a first electrically conductive wire having at least first, second and third wire portions extending in one direction, a first wire bight portion connecting one end of said first wire portion to an adjacent end of said second wire portion, and a second wire bight portion connecting an opposite end of said second wire portion to an adjacent end of said third wire portion to provide a serpentine configuration;

a second electrically conductive wire having at least fourth, fifth, and sixth wire portions extending in another direction, a third wire bight portion connecting one end of said fourth wire portion to an adjacent end of said fifth wire portion, and a fourth wire bight portion connecting an opposite end of said fifth wire portion to an adjacent end of said sixth wire portion to provide a serpentine configuration;

said first wire being disposed adjacent to said second wire and being oriented at a predetermined angle thereto so that said first wire crosses said second wire at aligned points, said angle being greater than zero degrees;

receptacle means for receiving one of the light bulbs, power cord plugs and the like being disposed at selected ones of said aligned points, each of said receptacle means including two spaced apart electrical terminals;

one of said terminals of each of said receptacle means being connected to said first wire and the other of said terminals of each of said receptacle means being connected to said second wire to provide a parallel circuit; and said first and second wires being separately connected to line wire means for connection to an electrical power source.

2. An electrical receptacle arrangement according to claim 1, wherein each of said receptacle means includes a threaded opening to threadedly receive a light bulb, said terminals being in said opening for contacting the light bulb.

3. An electrical receptacle arrangement according to claim 2, wherein said first and second wires are arranged to provide a net-like construction.

4. An electrical receptacle arrangement according to claim 3, wherein said net-like construction is flexible to drape over and around a Christmas tree.

5. An electrical receptacle arrangement according to claim 4, wherein portions of said first and second wires, which extend between said receptacle means, are insulated.

6. An electrical receptacle arrangement according to claim 2, wherein said receptacle means are fixed relative to each other in a ceiling with only said receptacle means being exposed from the ceiling.

7. An electricasl receptacle arrangement according to claim 1, wherein each of said wires has a continuous one piece construction.

8. An electrical receptacle arrangement according to claim 7, wherein portions of said first and second wires are insulated, and non-insulated portions of said first and second wires are at said selected ones of said aligned points for connection to said terminals.

9. An electrical receptacle arrangement according to claim 1, wherein ends of said first and second wires are connected to an electrical power cord having a plug on an end thereof.

10. An electrical receptacle arrangement according to claim 1, wherein a front end of each of said receptacle means has a pair of slots therein extending inwardly to receive prongs of a power cord plug of an electrical device.

11. An electrical receptacle arrangement according to claim 10, wherein associated ends of said first and second wires are connected to an electrical power cord having a plug on an end thereof for plugging into the electrical power source.

12. An electrical receptacle arrangement according to claim 11, wherein each of said first and second wires has a continuous one piece construction.

13. An electrical receptacle arrangement according to claim 1, wherein said selected ones of said aligned points include all said aligned points.

14. An electrical receptacle arrangement according to claim 1, wherein said selected ones of said aligned points include alternate ones of said aligned points.

15. An electrical receptacle arrangement according to claim 1, wherein said receptacle means include receptacles fabricated from plastic and having said terminals therein fabricated from metal.

16. An electrical receptacle arrangement according to claim 1, wherein said predetermined angle is 90 degrees so that said first and second wires are disposed at right angles to each other.

17. An electrical receptacle arrangement according to claim 1, wherein said first and second wires are arranged to provide a net-like construction.

18. An electrical receptacle arrangement according to claim 17, wherein each of said wires has a continuous one piece construction with portions of said wires, which extend between said receptacle means, being insulated.

19. An electrical receptacle arrangement according to claim 18, wherein said first wire is disposed over said second wire.

20. An electrical receptacle arrangement according to claim 18, wherein said first wire is disposed in front of said second wire.

* * * * *